US006726009B1

(12) United States Patent
Larson et al.

(10) Patent No.: US 6,726,009 B1
(45) Date of Patent: Apr. 27, 2004

(54) THROAT STRUCTURE FOR GOLF BAGS

(75) Inventors: Ryan M. Larson, Scottsdale, AZ (US); John A. Solheim, Phoenixe, AZ (US)

(73) Assignee: Karsten Manufacturing Corporation, Phoenix, AR (US)

( * ) Notice: Subject to any disclaimer, the term of this patent is extended or adjusted under 35 U.S.C. 154(b) by 14 days.

(21) Appl. No.: 10/281,665

(22) Filed: Oct. 28, 2002

(51) Int. Cl.[7] ..... A63B 55/00
(52) U.S. Cl. ..... 206/315.6; 206/315.3
(58) Field of Search ..... 206/315.3, 315.5, 206/315.6; 211/70.2; D3/320; 280/DIG. 6

(56) References Cited

U.S. PATENT DOCUMENTS

| | | | | | |
|---|---|---|---|---|---|
| 1,726,245 | A | | 8/1929 | Shelton | |
| 1,956,008 | A | | 4/1934 | Deibel | |
| 4,596,328 | A | | 6/1986 | Solheim | |
| D323,741 | S | | 2/1992 | Antonious | |
| 5,099,990 | A | | 3/1992 | Antonious | |
| 5,103,974 | A | | 4/1992 | Antonious | |
| D327,168 | S | | 6/1992 | Antonious | |
| 5,860,520 | A | * | 1/1999 | Tang | 206/315.6 |
| 5,918,737 | A | * | 7/1999 | Kwon | 206/315.3 |
| 6,138,825 | A | * | 10/2000 | Summerlin | 206/315.6 |
| 6,158,581 | A | * | 12/2000 | Hong | 206/315.3 |

FOREIGN PATENT DOCUMENTS

| | | | | |
|---|---|---|---|---|
| DE | 10245415 A1 | * | 9/2003 | A63B/55/00 |
| WO | WO9118650 | * | 12/1991 | |

* cited by examiner

*Primary Examiner*—Sue A. Weaver
(74) *Attorney, Agent, or Firm*—Darrell F. Marquette

(57) ABSTRACT

In a golf bag that includes a body with a top end and a bottom end, a throat structure is mounted in the top end of the body. The throat structure has a substantially ring shaped outer wall and a substantially ring shaped inner wall spaced inwardly from the outer wall. The inner wall defines a first compartment. First and second divider bars extend between the inner and outer walls and are arranged generally parallel to each other to define a second compartment on one side of the first compartment. Third and fourth divider bars extend between the inner and outer walls and are arranged generally parallel to each other to define a third compartment on the opposite side of the first compartment. The first compartment has a generally elliptical shape and is preferably sized to hold a plurality of golf clubs while the second and third compartments each have a generally square shape and are each preferably sized to hold a single golf club. Fourth and fifth compartments are located along a front side of the throat structure while a sixth compartment is located along a back side of the throat structure. The fourth, fifth and sixth compartments are each preferably sized to hold a plurality of golf clubs.

6 Claims, 3 Drawing Sheets

THROAT STRUCTURE FOR GOLF BAGS

BACKGROUND OF THE INVENTION

This invention relates generally to golf equipment and, in particular, to a throat structure for golf bags.

Throat structures have been used in golf bags to separate golf clubs stored therein into groups. These throat structures typically include two or three divider bars that extend transversely across an open top end of a golf bag and divide this open top end into separate compartments for separating golf clubs. Sometimes, the divider bars are joined to each other by additional bars.

U.S. Pat. No. 4,596,328 to J. A. Solheim discloses a throat structure mounted in an open top end of a golf bag. The throat structure includes a divider which separates the open top of the golf bag into four compartments. The divider includes a pair of divider bars which are connected to each other near their centers by a rib. The divider bars are angled away from each other as they extend outwardly from the rib. This arrangement of the divider bars causes golf clubs, which are inserted into the golf bag through the throat structure, to gather and remain in outer corners of two of the compartments and in an inner corner of one compartment.

U.S. Pat. No. 5,099,990 to A. J. Antonious discloses an insert for use in an open top end of a golf bag. In one embodiment, the insert includes a primary compartment surrounded by a plurality of secondary compartments. The primary compartment extends above the secondary compartments a sufficient distance so that golf clubs stored in the primary compartment are protected from golf clubs stored in the secondary compartments. In another embodiment, the insert has a primary compartment which is eccentrically located with respect to the secondary compartments.

SUMMARY OF THE INVENTION

The present invention provides a throat structure for a golf bag wherein the golf bag includes a body with a top end and a bottom end. The throat structure is mounted in the top end of the body and includes a substantially ring-shaped outer wall and a substantially ring-shaped inner wall spaced inwardly from the outer wall. The inner wall defines a first compartment. First and second divider bars extend between the inner and outer walls. The first and second divider bars are arranged generally parallel to each other to define a second compartment on one side of the first compartment. Third and fourth divider bars extend between the inner and outer walls. The third and fourth divider bars are arranged generally parallel to each other to define a third compartment on the opposite side of the first compartment. A fifth divider bar extends between the inner and outer walls to define fourth and fifth compartments located along a front side of the throat structure. The first and third divider bars cooperate with the inner and outer walls to define a sixth compartment located along a back side of the throat structure.

The first, fourth, fifth and sixth compartments are each preferably sized to hold a plurality of golf clubs, and the second and third compartments are each preferably sized to hold a single golf club. Preferably, the first compartment has a generally elliptical shape and the second and third compartments each have a generally square shape. Preferably, the first, second, third and fourth divider bars are of equal length while the fifth divider bar has a length greater than the length of each of the first, second, third and fourth divider bars.

DESCRIPTION OF THE PREFERRED EMBODIMENT

Figure 1:
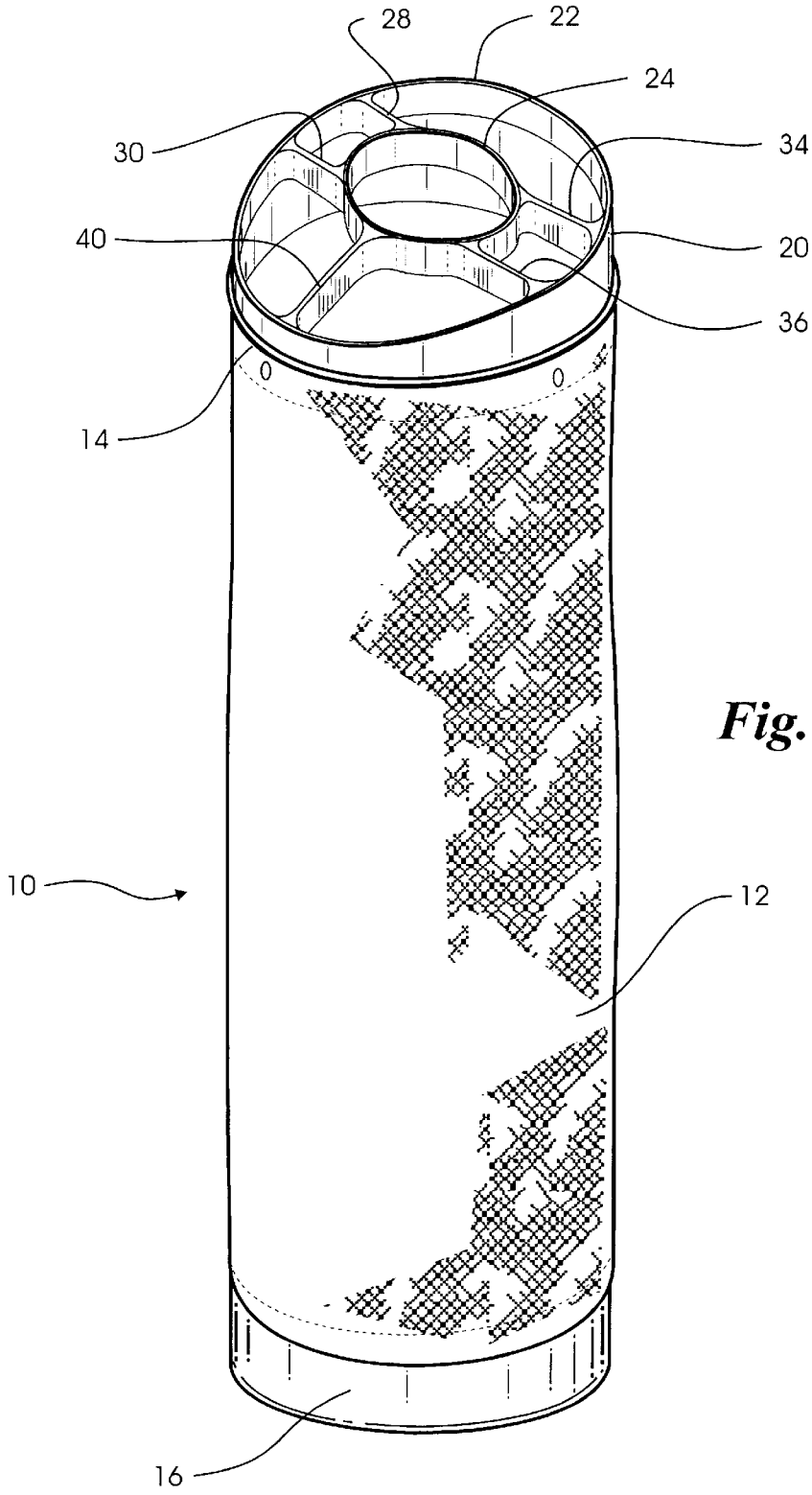
FIG. 1 is a perspective view of a golf bag incorporating a throat structure according to the present invention.
Figure 2:
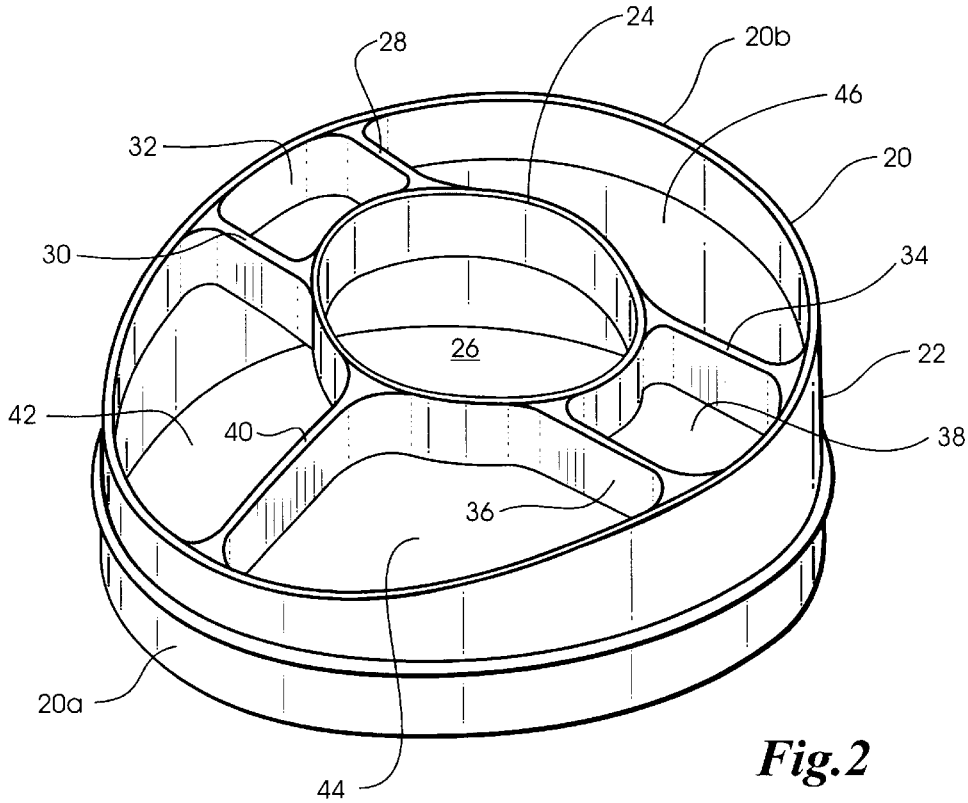
FIG. 2 is a perspective view of the throat structure.
Figure 3:
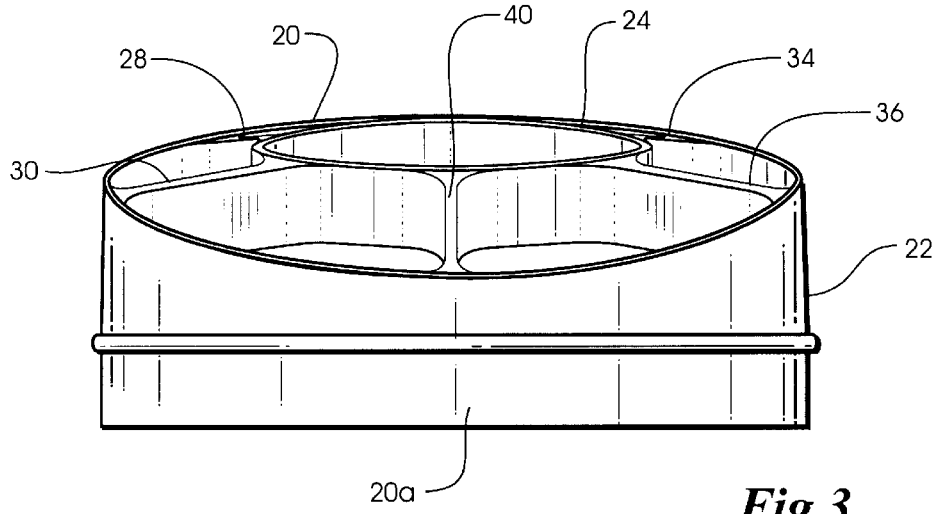
FIG. 3 is a front elevational view of the throat structure.
Figure 4:
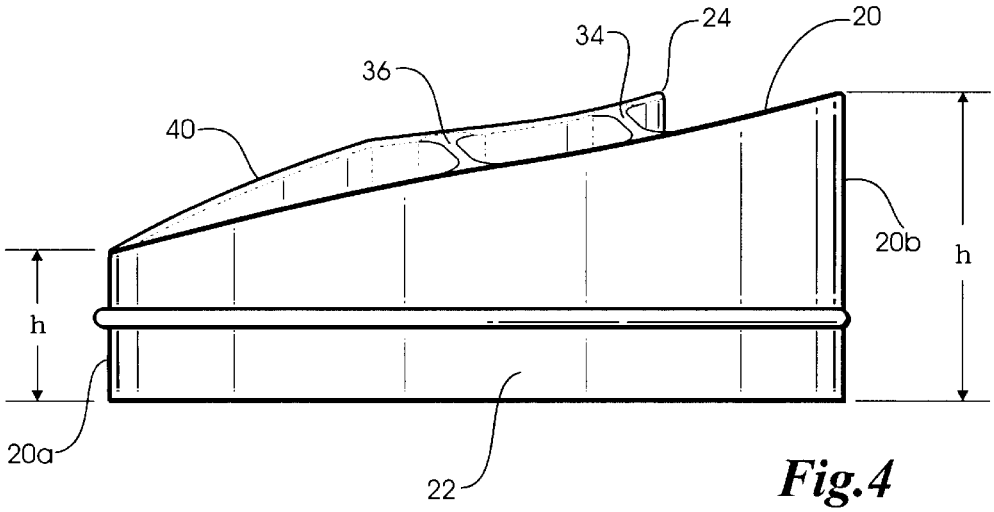
FIG. 4 is a side elevational view of the throat structure.
Figure 5:
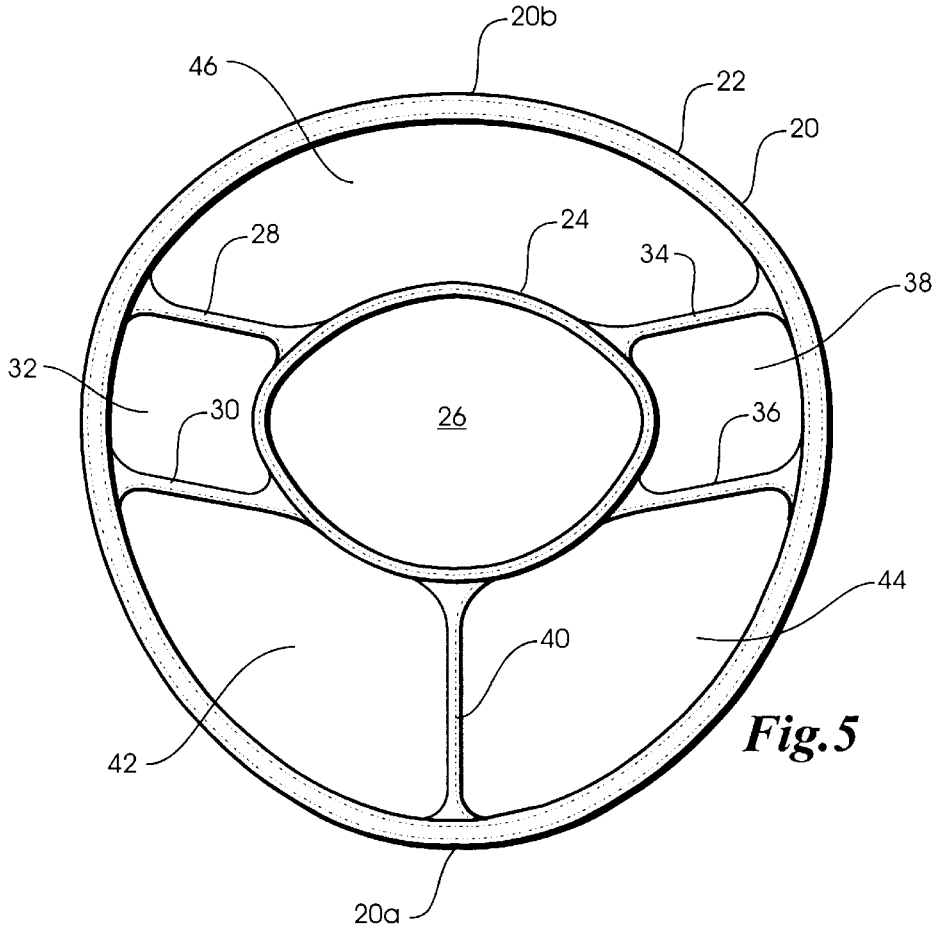
FIG. 5 is a top plan view of the throat structure.

Referring to FIG. 1, a golf bag 10 has a generally tubular body 12 with a top end 14 which is open and a bottom end 16 which is closed. Golf clubs may be inserted and removed from the golf bag 10 through the top end 14 of the body 12 in conventional manner.

The top end 14 of the golf bag 10 is defined by a throat structure or divider 20 mounted therein and which is also shown in FIGS. 2–5. The throat structure 20 includes a substantially ring-shaped outer wall 22 with a height h (FIG. 4) that increases from a front side 20*a* of the throat structure 20 to a back side 20*b* thereof. This increase in the height h of the outer wall 22 slants the throat structure 20 forward for easier golf club insertion and removal. The outer wall 22 is secured to the body 12 by well known means such as sewing or riveting. The throat structure 20 also includes a substantially ring shaped inner wall 24 that is spaced inwardly from the outer wall 22. The inner wall 24 defines a first compartment 26 which is centrally located with respect to the body top end 14.

First and second divider bars 28 and 30, respectively, extend between the inner and outer walls 22, 24. The first and second divider bars .28, 30 are arranged so that they are generally parallel to each other thus defining a second compartment 32 on one side of the first compartment 26. Third and fourth divider bars 34 and 36, respectively, extend between the inner and outer walls 22, 24. The third and fourth divider bars 34, 36 are arranged so that they are generally parallel to each other thus defining a third compartment 38 on the opposite side of the first compartment 26.

A fifth divider bar 40 extends between the inner and outer wall 22, 24. The fifth divider bar 40 cooperates with the second and fourth divider bars 30, 36 to define fourth and fifth compartments 42 and 44, respectively, located along the front side 20*a* of the throat structure 20. The fourth compartment 42 is adjacent the second compartment 32, and the fifth compartment 44 is adjacent the third compartment 38. A sixth compartment 46 is located along the back side 20*b*of the throat structure 20 and is defined by the inner and outer walls 22, 24 and the divider bars 28, 34.

The first compartment 26 has a generally elliptical shape and is preferably sized to hold a plurality of golf clubs. The second and third compartments 32, 38 each have a generally square shape and are each preferably sized to hold a single golf club such as a driver or a putter. The fourth, fifth and sixth compartments 42, 44, 46 are each preferably sized to hold a plurality of golf clubs. In the preferred embodiment of the throat structure 20, the divider bars 28, 30, 34, 36 are of equal length while the fifth divider bar 40 is longer than each of the other divider bars. Also, the divider bars 28, 30, 34, 36 are each disposed at an included angle of approximately 95 to 110 degrees to the divider bar 40, preferably about 105 degrees.

The throat structure 20 may also include a strap guide (not shown) formed on its back side 20*b* opposite the divider bar

40. The strap guide is used to attach a shoulder strap (also not shown) to the body 12 at a location which provides proper balancing of the golf bag 10 when it is carried. The throat structure 20 is preferably molded from a suitable plastic such as polypropolene.

In normal use, a maximum of fourteen golf clubs could be carried in the golf bag 10. Typically, a driver would be inserted in one of the compartments 32 or 38, and a putter would be inserted in the other one of the compartments 32 or 38. Additional woods such as nos. 3, 4 and 5 would be inserted in the compartment 46, long irons such as nos. 2, 3 and 4 would be inserted in the compartment 26, and short irons such as nos. 5, 6, 7, 8, 9 and wedges would be inserted in the compartments 42 and 44.

What is claimed is:

1. A throat structure for a golf bag wherein the golf bag includes a body with a top end and a bottom end, said throat structure being mounted in the top end of said body and comprising:

a substantially ring-shaped outer wall;

a substantially ring-shaped inner wall spaced inwardly from said outer wall, said inner wall defining a first compartment;

first and second divider bars extending between said inner and outer walls, said first and second divider bars being arranged generally parallel to each other to define a second compartment on one side of said first compartment;

third and fourth divider bars extending between said inner and outer walls, said third and fourth divider bars being arranged generally parallel to each other to define a third compartment on the opposite side of said first compartment;

a fifth divider bar extending between said inner and outer walls for defining fourth and fifth compartments located along a front side of said throat structure;

said first and third divider bars cooperating with said inner and outer walls to define a sixth compartment located along a back side of said throat structure; and said first, second, third and fourth divider bars being of equal length, and said fifth divider bar having a length greater than the length of each of said first, second, third and fourth divider bars.

2. The throat structure of claim 1, wherein said first, fourth, fifth and sixth compartments are each sized for holding a plurality of golf clubs, and wherein said second and third compartments are each sized for holding a single golf club.

3. The throat structure of claim 1, wherein said outer wall has a generally circular shape.

4. The throat structure of claim 3, wherein said first compartment has a generally elliptical shape.

5. The throat structure of claim 1, wherein said first, second, third and fourth divider bars are each disposed at an included angle greater than 90 degrees to said fifth divider bar.

6. The throat structure of claim 1, wherein said outer wall has a height which increases from the front side of said throat structure to the back side thereof.

* * * * *